United States Patent [19]

Kaczerginski

[11] 4,440,975

[45] Apr. 3, 1984

[54] ELECTRICAL INSULATOR INCLUDING A MOLDED ONE-PIECE COVER HAVING PLATE-LIKE FINS WITH ARCUATELY DISPLACED MOLD LINE SEGMENTS

[75] Inventor: Alexandre Kaczerginski, Bellerive sur Allier, France

[73] Assignee: Ceraver, Paris, France

[21] Appl. No.: 400,292

[22] Filed: Jul. 21, 1982

[30] Foreign Application Priority Data

Aug. 5, 1981 [FR] France ..... 81 15203

[51] Int. Cl.[3] ..... H01B 17/02

[52] U.S. Cl. ..... 174/209; 29/631; 174/179; 174/212; 264/DIG. 54

[58] Field of Search ..... 174/140 S, 178, 179, 174/209, 212; 29/631; 249/95, 160; 264/276, DIG. 54; 425/451.9

[56] References Cited

U.S. PATENT DOCUMENTS

| | | | |
|---|---|---|---|
| 3,534,133 | 10/1970 | Koch et al. | 174/178 X |
| 3,786,175 | 1/1974 | Proctor | 174/179 X |

FOREIGN PATENT DOCUMENTS

| | | | |
|---|---|---|---|
| 1932949 | 1/1971 | Fed. Rep. of Germany | 174/179 |
| 2832543 | 2/1979 | Fed. Rep. of Germany | 174/179 |
| 1396819 | 3/1965 | France | 174/212 |
| 2374729 | 7/1978 | France | 174/179 |

*Primary Examiner*—Laramie E. Askin

*Attorney, Agent, or Firm*—Kenyon & Kenyon

[57] ABSTRACT

An electrical insulator component comprises a one-piece block of moulded fins (11, 12, 13) disposed around an insulating core (10). The surface of the block of fins includes a moulding line (21, 22, 23) and said moulding line has arcuately displaced segments in that the portion 22 extends circumferentially while the portions 21 and 23 extend longitudinally but in different planes. The net result is that dirt building up along the join line does not form a continuous straight-line low resistance path for leakage currents.

4 Claims, 2 Drawing Figures

ELECTRICAL INSULATOR INCLUDING A MOLDED ONE-PIECE COVER HAVING PLATE-LIKE FINS WITH ARCUATELY DISPLACED MOLD LINE SEGMENTS

BACKGROUND OF THE INVENTION

The present invention relates to an electrical insulator component comprising a one-piece block of insulating fins.

Such insulator components comprise an elongate central insulating core surrounded by fins. The core may be a composite rod of glass or synthetic fibers belonging to an electrical insulator. It may alternatively be a support such as the end of a high tension cable, a cross bar, or an insulator tube for a circuit-breaker chamber. The central core is generally protected by a waterproof elastomer covering comprising a sheath and/or fins.

In a first known method of applying fins, separate fins are threaded over a previously sheathed core. The fins are then stuck together end to end. Alternatively the fins may be moulded in succession by moving a mould along said core.

In a second known method for applying fins, all the fins are simultaneously moulded about the central core. In this case, it is necessary for the mould to be in at least two parts which when joined together define a "join plane" in which the axis of the insulator component lies. The result is that all the fins show traces of said "moulding join" corresponding to the axial "join plane". These traces are in the form of a continuous straight-line path running from end to end of the insulator component. By facilitating the deposit of pollution particles, said line leads to high leakage currents and to risks of damage.

Preferred embodiments of the present invention mitigate these drawbacks.

SUMMARY OF THE INVENTION

The present invention provides an electrical insulator component comprising a one-piece block of moulded fins disposed around an insulating core, wherein the surface of the block of fins includes a moulding line having arcuately displaced segments between the edges of the end fins.

In one embodiment, the arcuate displacement of mold line segments occurs along the edge of at least one of the intermediate fins. The arcuate displacement may correspond, for example, to a 90° shift about the axis of the component between the join line on one side of a fin and the join line on the other side, with the shifted join lines being interconnected by a join line running around the edge of the fin.

BRIEF DESCRIPTION OF THE DRAWINGS

An embodiment of the invention is described by way of example with reference to the accompanying drawing, in which.

DETAILED DESCRIPTION OF THE PREFERRED EMBODIMENT

Figure 1:
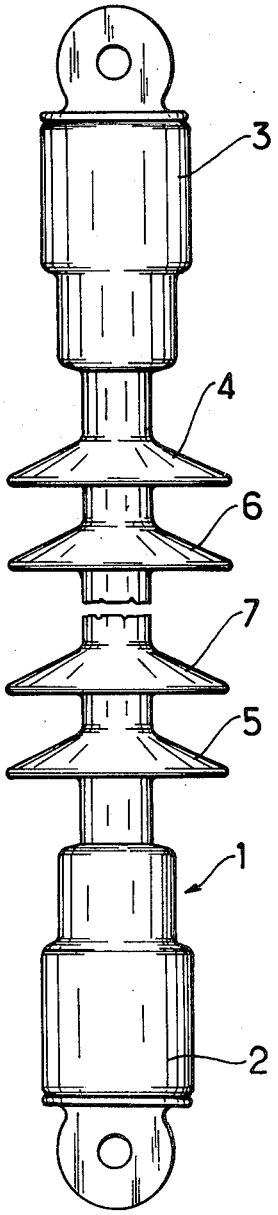
FIG. 1 is a partial elevation of an insulator component in accordance with the invention.
Figure 2:
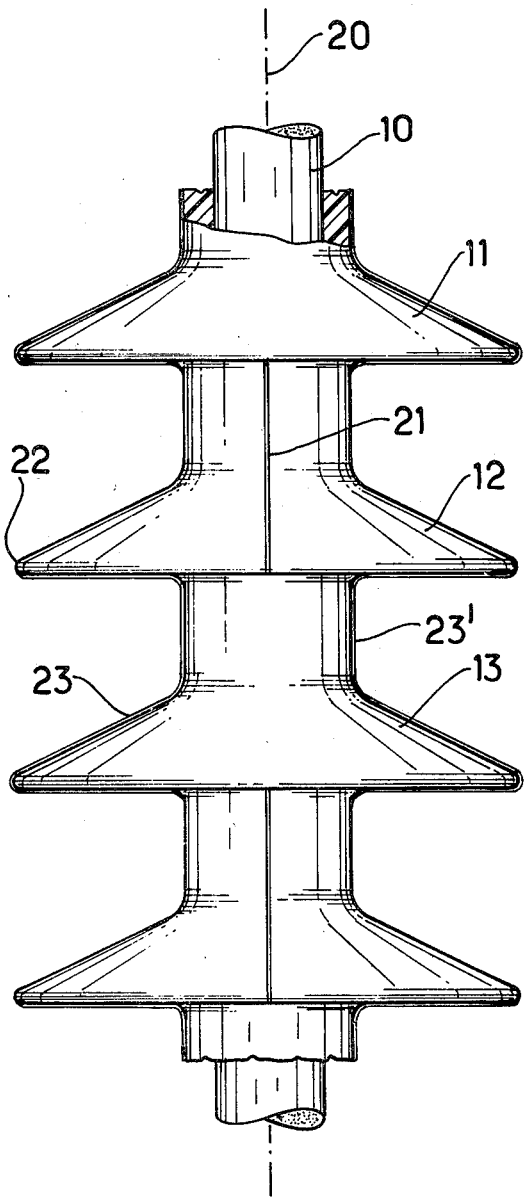
FIG. 2 is is a partial elevation, on a larger scale, of a portion of the insulator shown in FIG. 1.

FIG. 1 shows a composite insulator 1 having two end pieces 2 and 3 and an insulating member constituted by an insulating rod 10 (see FIG. 2) protected by a one-piece block of fins including end fins 4 and 5 and intermediate fins 6, 7 (FIG. 1) and 11, 12, 13 (FIG. 2).

The insulating assembly has circular symmetry about an axis 20. FIG. 2 shows the mould join following a line 21 on the bottom face of the fin 11, an intermediate sleeve portion between the fins 11 and 12, and the top face of the fin 12. The join line is then arcuately displaced, proceeding around the rim 22 of the fin 12 to continue as a line 23 in the plane of the figure over the bottom of the fin 12, the intermediate sleeve between the fins 12 and 13 and over the top of the fin 13. A second join line 23' symmetrically disposed about the axis of the insulator relative to the line 23 can be seen on the other side of the figure, while the line symmetrically disposed relative to the join line 21 is not visible in the figure.

A plurality of partial moulds, each comprising two half shells are used to make such a block of fins. The axial join planes of pairs of adjacent partial moulds are shifted relative to one another to obtain the desired degree of arcuate displacement at a desired angle (90° being merely an example).

Naturally there may be several arcuate displacements between the end fins 4 and 5.

In an embodiment that is not shown, at least one of the arcuate displacements may appear on the surface of the sleeves between two fins.

The invention can be applied to all shapes of fins, regardless of whether the surfaces are conical or flat or of whether they have obstructions to unmoulding.

The use of the terms top and bottom is arbitrary and relates to the disposition shown in the drawing.

The fins may be made of a material chosen from: EPDM (Ethylene—Propylene—Diene—Monomer); silicones; polyurethanes; or any other insulating elastomer, epoxy or the like.

In all cases an insulating component in accordance with the invention reduces the risk of a low resistance leakage current path building up along the mould line. As mentioned in the introduction, composite insulators are merely one of many possible applications that make use of an insulator component in the form of a moulded block of fins.

I claim:

1. An electrical insulator including an elongated insulating core having a longitudinal axis and a one-piece molded insulator cover disposed around the core, the cover having a plurality of axially spaced plate-like fins and a sleeve portion between each pair of adjacent fins, each fin having a circumferential edge which is symmetrical with respect to the axis of the core, and the surface of the cover having a mold line which extends from one end of the cover to the other end, wherein the improvement comprises:

said mold line has at least two arcuately displaced segments between the edges of the end fins.

2. An electrical insulator according to claim 1 wherein the cover comprises at least one fin intermediate the end fins, and the arcuate displacement of mold line segments occurs at the edge of at least one of the intermediate fins.

3. An electrical insulator according to claim 2, wherein the arcuate displacement of mold line segments subtends an angle of approximately 90°.

4. An electrical insulator according to claim 1, wherein the arcuate displacement of mold line segments occurs on the surface of a sleeve portion between two adjacent fins.

* * * * *